US006563934B1

(12) United States Patent
Swope et al.

(10) Patent No.: US 6,563,934 B1
(45) Date of Patent: May 13, 2003

(54) MECHANICALLY TUNABLE DIAPHRAGM USING NICKEL TITANIUM MEMORY METAL

(75) Inventors: Charles B. Swope, Coral Springs, FL (US); Bruce W. Staple, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/550,135

(22) Filed: Apr. 17, 2000

(51) Int. Cl.[7] ..... H04R 1/00; C22C 43/00

(52) U.S. Cl. ..... 381/427; 381/423; 148/402; 148/563

(58) Field of Search ..... 381/426, 427, 381/423; 148/402, 563; 181/208, 167, 168

(56) References Cited

U.S. PATENT DOCUMENTS 5,005,678 A * 4/1991 Julien et al. ..... 188/378

* cited by examiner

*Primary Examiner*—Sinh Tran

(74) *Attorney, Agent, or Firm*—Miller, Johnson, Snell & Cummiskey, P.L.C.

(57) ABSTRACT

A diaphragm includes a vibratory membrane and at least one nickel titanium memory metal member having a shape that can be mechanically adjusted with a heating signal. The mechanical adjustment of the at least one nickel titanium memory metal member tunes the frequency response of the vibratory membrane in the diaphragm. The at least one nickel titanium memory metal member can be a sheet providing a vibratory membrane, or sheet sections or wire made of nickel titanium memory metal bonded to a vibratory membrane.

35 Claims, 4 Drawing Sheets

MECHANICALLY TUNABLE DIAPHRAGM USING NICKEL TITANIUM MEMORY METAL

TECHNICAL FIELD

This invention relates in general to diaphragms, and more particularly to a diaphragm whose frequency response may be changed by application of mechanical tension to the diaphragm.

DESCRIPTION OF THE PRIOR ART

A speaker, a microphone, a vibrator, or other similar electrical transducer device, typically comprises a diaphragm. The diaphragm, in such a device, normally oscillates as part of a vibrating transducer to convert electrical signals to mechanical motion or vice versa. As is well known by those of ordinary skill in the art, such electrical transducer devices are commonly found in communication devices, such as cellular phones, pagers, radios, and wireless communicators. Speakers typically convert electrical signals to audio output. Microphones normally convert audio input to electrical signals output. Vibrators are normally output devices that can provide a tactile signal to a user of a communication device. However, vibrators can additionally be input devices that convert mechanical vibrations to electrical signals. In all of these electrical transducer devices, the diaphragm is a key component. The frequency response of the diaphragm normally must be designed to match a particular application. Each application utilizes a specifically customized design for frequency response of a diaphragm.

The type of material used in the diaphragm typically provides a frequency response for the vibrating transducer. This material is selected by design for a particular application. In order to achieve broader frequency response for a diaphragm, normally after selecting a particular material, a mechanical adjustment is made to the diaphragm by changing a tension across the overall diaphragm. Traditionally, to change the tension of the diaphragm, a mechanical means, such as a motor or geared structure, varies a tension of a membrane in the diaphragm such as by varying a pulling force across the membrane. This changing of the tension of the membrane to customize (mechanically tune) a frequency response of the diaphragm for a particular application can be a complex, manually intensive, time consuming, and expensive process for a manufacturing technician.

Unfortunately, there are no standard ways to mechanically tune a diaphragm to match a desired frequency response. Consequently, a manufacturer of devices for different applications must inventory different diaphragms that have been individually customized for different frequency responses, as required by the different applications. This results in additional costs for maintaining an inventory of the different diaphragms.

Thus, there is a need for a more easily tunable diaphragm that can be easily customized for different applications.

DESCRIPTION OF THE PREFERRED EMBODIMENTS

This invention utilizes a new diaphragm manufacturing process to significantly improve the tuning of frequency response of diaphragms for many different applications. Additionally, tuning flexibility reduces the number of different custom diaphragms that must be maintained in inventory for different product applications in a manufacturing process. As will be discussed in detail below, a preferred diaphragm of the present invention utilizes a new and novel application of nickel titanium memory metal mechanically coupled to a membrane of a diaphragm to allow flexible adjustment of the frequency response of the diaphragm.

Nickel titanium is a memory metal, as is well known to one of ordinary skill in the art, that changes shape relative to a memory position that has been programmed into the metal. An example of a sheet (foil) version of nickel titanium is Nitinol sheet supply manufactured by Shape Memory Applications, Inc., of Santa Clara, Calif. To program a memory position the nickel titanium is heated to a very high temperature, such as approximately 500 degrees centigrade, while holding the metal structure in the desired position. Under normal operation, the metal structure is captured in an operating position. When heat, such as approximately 120 degrees centigrade, is applied to the metal, the metal shape may move toward the memory position or away from the memory position, depending on the programmed memory position relative to the captured operating position.

Figure 1:
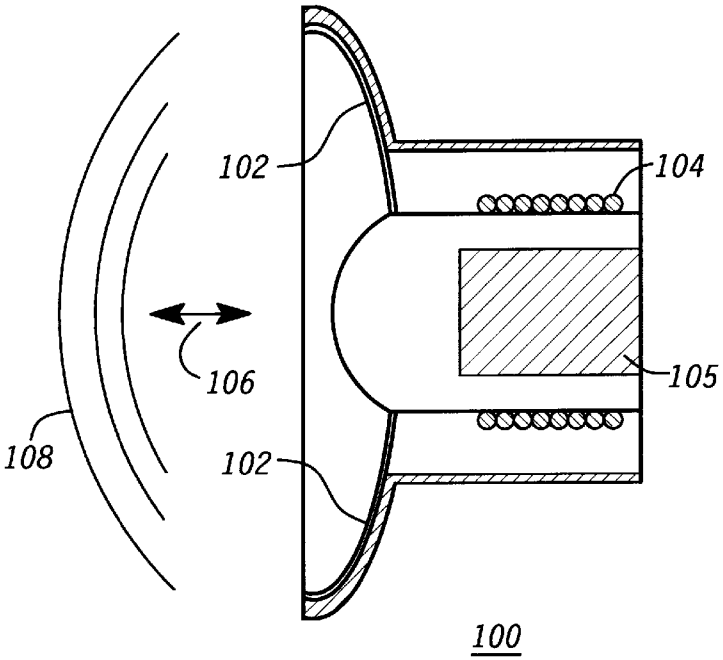
FIG. 1 is a cross sectional side view of an exemplary speaker driving a diaphragm to generate audio.

Referring to FIG. 1, a speaker 100 is shown in a typical operation. The speaker 100 drives a diaphragm 102 to oscillate 106 thereby creating audible sound waves 108. A drive mechanism, such as moving drive coils 105 working against a fixed core 105, provides the power to drive the speaker diaphragm 102 to generate sound.

It is well known by those of ordinary skill in the art that the frequency response of the diaphragm has significant impact on the operation of the speaker to generate sound at different frequencies. In certain speaker applications, for example, it is normally very desirable to have a flat frequency response over a wide frequency range. However, in other applications it may be desirable to have a more pre-emphasized or de-emphasized frequency response over a similar frequency range. Further, in some applications where certain key frequencies are normally generated and other frequencies are unwanted it may be desirable to emphasize those key frequencies of interest. In the different cases described above, the frequency response of the diaphragm can either help or hinder the overall performance of a speaker system. This is especially important to users of speaker phones and other audio output devices that are perceived by users as quality products based to a great extent on their audio quality.

Figure 2:
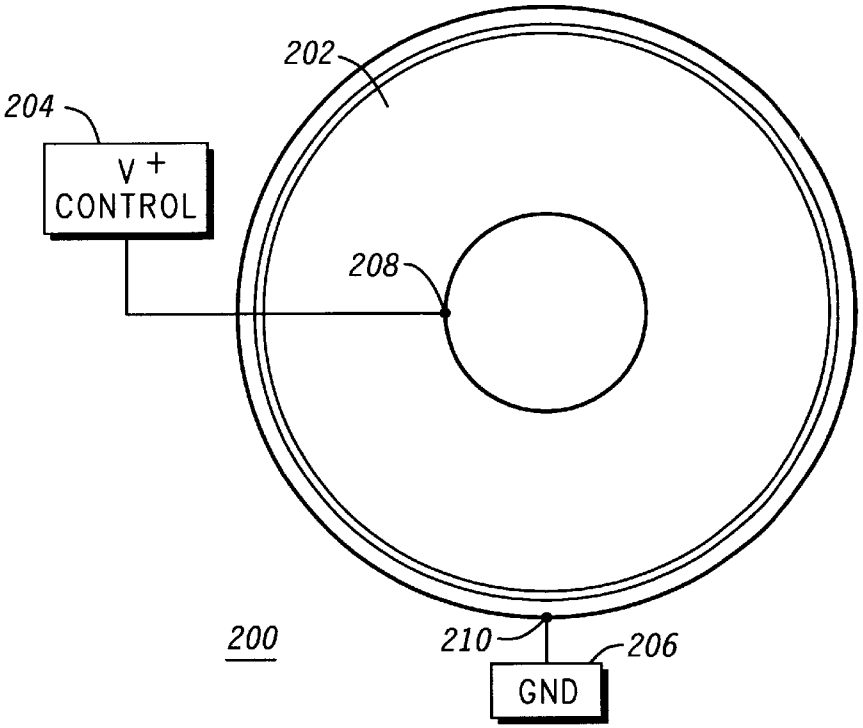
FIG. 2 is a front planar view of an diaphragm utilizing nickel titanium memory metal in accordance with a first preferred embodiment of the present invention.

Referring to FIG. 2, a diaphragm 200 comprises a membrane 202 that may be flexibly adjusted for varying the frequency response of the diaphragm 200 according to a first preferred embodiment of the present invention. The membrane 202 comprises a sheet of nickel titanium that is in the shape of the membrane 202. Nickel titanium is commercially available in sheets of different thickness. These sheets when cut or stamped or otherwise formed to a desired shape are suitable for use in diaphragms 200 in accordance with the first preferred embodiment of the present invention. These diaphragms 200 may be used to generate vibrations in speakers, vibrators, and other such vibrating devices.

In the first preferred embodiment, before the diaphragm 200 is mounted in a vibratory transducer device, such as in a speaker, microphone, or vibrator, the diaphragm membrane 202 is mechanically adjusted (tuned) to change shape and/or tension across the membrane 202 by applying a heat signal to the membrane 202. A heat signal can be applied either from an external heat source or by selectively running electrical current through at least a portion of the membrane 202 to create heat therein. For example, as shown in FIG. 2, a controlled voltage source 204 is electrically coupled to the membrane 202 at a first point 208, such as at an inner edge of the membrane 202. A ground reference 206 is electrically coupled to a second point 210 in the membrane 210, such as at an outer edge of the membrane 206. The current running between the first and second points in the membrane 202 changes the shape of the nickel titanium in the membrane 202 and thereby changes the frequency response of the membrane 202. The membrane 202 is normally captured in the diaphragm 200 about at least one edge of the membrane 202. The change in shape of the membrane 202 changes the tension across the captured membrane 202 and changes the frequency response thereof.

According the preferred embodiment discussed above, an entire membrane 202 structure may comprise nickel titanium memory metal. A diaphragm comprising a metallic membrane 202 provides significant advantages in applications where the vibrating transducer is to be operated in a hot environment, typically greater than ambient room temperatures.

Figure 3:
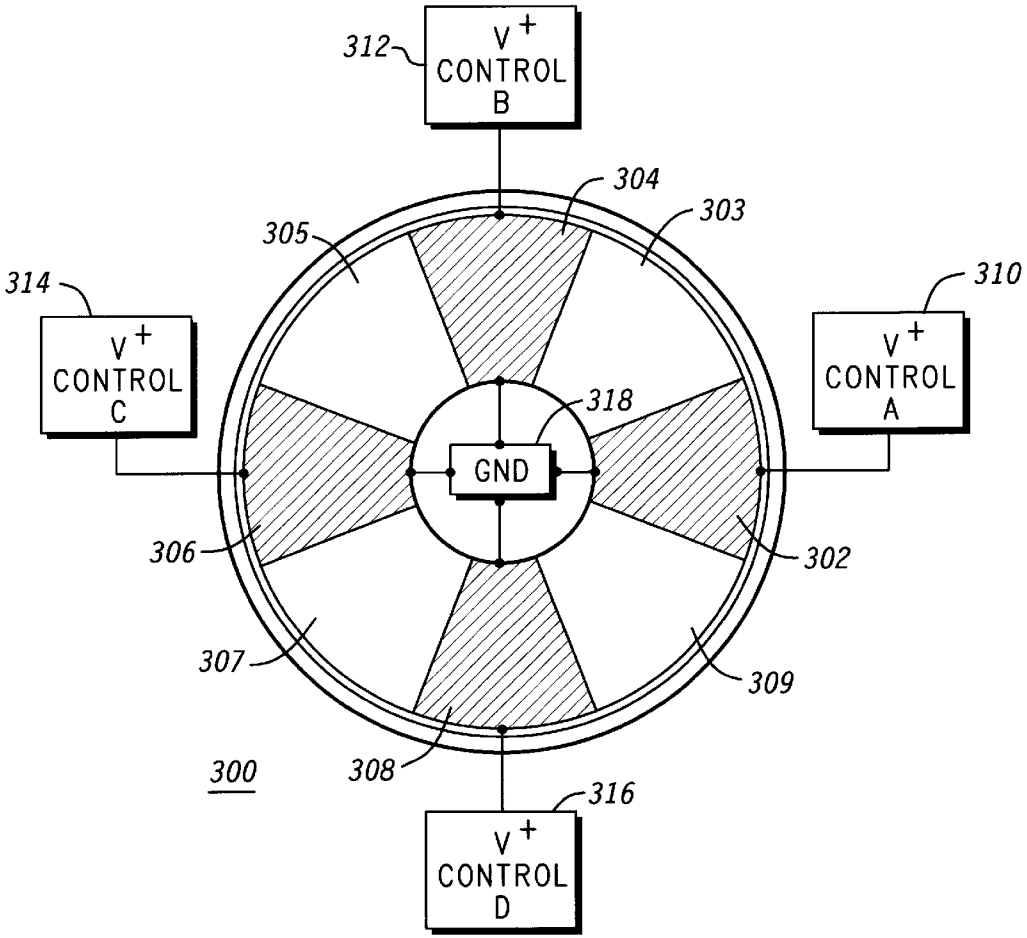
FIG. 3 is a front planar view of an diaphragm utilizing nickel titanium memory metal in accordance with a second preferred embodiment of the present invention.

Referring to FIG. 3, a second preferred embodiment of a membrane 300 is illustrated. The membrane 300 comprises at least one section of nickel titanium sheet stock mechanically coupled to at least one associated section of membrane. In this example, four generally wedge shaped sections of nickel titanium sheet 302, 304, 306, 308, are mechanically coupled to four generally wedge shaped sections of membrane material 303, 305, 307, 309, in an alternating pattern as illustrated in FIG. 3. In this example, the sections of nickel titanium 302, 304, 306, 308, are bonded to the four other sections of membrane material 303, 305, 307, 309, at their edges that extend radially outward from the center of the membrane 300, as illustrated in FIG. 3. Alternatively, an integral sheet of membrane material can provide a substrate where the at least one sheet of nickel titanium, in this case four sections of nickel titanium 302, 304, 306, 308, are bonded to the front surface of the membrane material. Other generally similar arrangements for mechanically coupling the one section of nickel titanium sheet to the at least one section of membrane material to create such a membrane 300 for a diaphragm should be obvious to those having ordinary skill in the art.

As shown in FIG. 3, the mechanical resonance and frequency response of the membrane 300 can be tuned by selectively applying heat energy to any of the nickel titanium sections 302, 304, 306, 308, to change the shape, and/or the tension across, the particular nickel titanium section. In this example, controlled voltage, such as from a voltage control source 310, 312, 314, 316, (a heating signal) is selectively applied to any of the particular nickel titanium sections 302, 304, 306, 308. As shown in FIG. 3, a voltage control source 310, 312, 314, 316 is electrically coupled to first point on a particular nickel titanium section, 304,306,308, such as at an outer edge of the membrane 300, 302. A ground reference 318 is electrically coupled a second point of each of the nickel titanium sections 302, 304, 306, 308, such as a radially inner edge of the membrane 300, as shown. In this way, a heating current signal is selectively applied to any of the nickel titanium sections, 302, 304,306, 308, from a first point, such as at an outer edge of the membrane 300, to a second point, such as at an inner edge of the membrane 300. Thereby, the frequency response of portions of the membrane 300 can be selectively tuned and adjusted to obtain a desired overall frequency response for the membrane 300 for a diaphragm to be used in a particular application.

Figure 5:
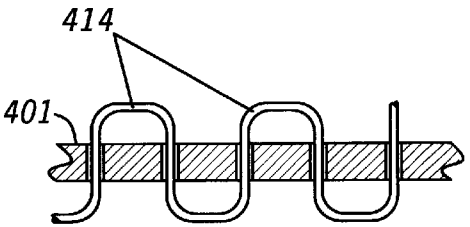
FIG. 5 is a cross sectional side view of a portion of a diaphragm utilizing nickel titanium memory metal in accordance with a fourth preferred embodiment of the present invention.
Figure 4:
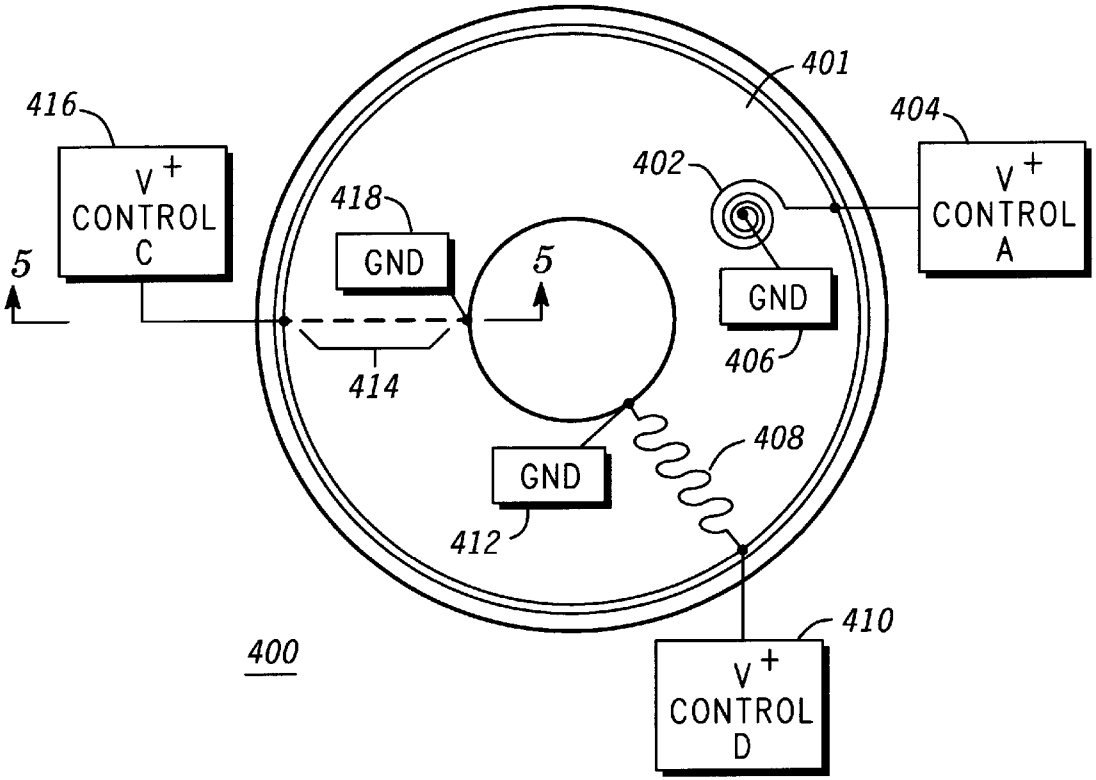
FIG. 4 is a front planar view of a diaphragm utilizing nickel titanium memory metal in accordance with a third preferred embodiment of the present invention.

Referring to FIG. 4, a membrane 400 is illustrated in accordance with a third preferred embodiment of the present invention. In this alternative configuration for a membrane 400, nickel titanium wire in different shapes, such as shown with a first wire arrangement 402, and a second wire arrangement 408, and a third wire arrangement 414, is incorporated into the membrane layer 401. FIG. 5 illustrates a side view of the third nickel titanium wire 414 incorporated into the membrane sheet 401. As a first example, the first nickel titanium wire 402 is arranged in a spiral and mechanically coupled to the membrane 400 on the surface of the membrane layer 401. For example, an adhesive may bond the first nickel titanium wire 402 to the front surface of the membrane layer 401. A first point of the first nickel titanium wire 402 is electrically coupled to the voltage control source 404 and a second point of the wire 402 is electrically coupled to a ground reference 406. When a heating current signal is selectively applied to the nickel titanium wire 402 it causes the wire to change shape, either toward a memory position or away from a memory position as discussed before. By changing the shape of the wire 402 the tension of the membrane 400 is changed about the portion of the membrane 400 where the wire 402 is mechanically coupled to the membrane layer 401. This change in tension across the membrane 400 changes the frequency response of the membrane 400.

As a second example, the second nickel titanium wire 408 is shown mechanically coupled to the front surface of the membrane layer 401. The second nickel titanium wire 408 is arranged in a repeating "S" pattern, or a zig-zag pattern, laterally coupled to the front surface of the membrane layer 401, as shown in FIG. 4. For example, the second wire 408 may be bonded with an adhesive to the front surface of the membrane layer 401. A first point on the second nickel titanium wire 408 is electrically coupled to the voltage control source 410. A second point on the second wire 408 is electrically coupled to a ground reference 412. Similar to the discussion above with respect to the first wire, the second nickel titanium wire 408 changes shape in response to a heating current selectively applied to the second nickel titanium wire 408 between the first point and the second point of the second wire 402, as shown. The change in shape of the second wire 408 may be toward a memory position or away from a memory position of the second wire 408. In this way, the frequency response of the membrane 400 can be tuned by changing the tension of the membrane layer 401 about the second nickel titanium wire 408.

As a third example, a third nickel titanium wire 414 is stitched or interleaved, between a front surface of the membrane layer 401 and a back surface of the membrane layer 401. See FIG. 5. A voltage control source 416 is electrically coupled to a first point on the third nickel titanium wire 414 and a ground reference 418 is electrically coupled to a second point on the third nickel titanium wire 414, as shown in FIG. 4. When a heating current is applied to the third nickel titanium wire 414 it changes shape. The third wire 414 moves toward a memory position or away from a memory position depending on the arrangement of the third wire 414 relative to programmed memory position for the third wire 414. As the third wire 414 changes shape it mechanically tunes the frequency response of the membrane 400 about the third nickel titanium wire 414. The changing shape of the third wire 414 changes the tension across the membrane layer 401 and thereby changes the frequency response of the membrane 400. Therefore, as discussed above in the three examples using nickel titanium wire, the frequency response of the membrane 400 can be changed to a desired frequency response utilizing selective shaping of the frequency response via changing the shape of each of the nickel titanium wires 402, 408, 414.

Nickel titanium wire is less expensive than nickel titanium sheets to manufacture and to incorporate into a membrane 400. This makes nickel titanium wire a desirable mechanism for tuning the frequency response of a membrane 400 in most applications. However, as discussed above, it may also be desirable to utilize sections of nickel titanium sheet mechanically coupled to a membrane or even a nickel titanium sheet for an entire membrane in accordance with particular requirements of certain applications. Additionally, the nickel titanium wire may be as thin as human hair. This makes the nickel titanium wire very low cost as a means of mechanically tuning frequency response of a membrane 400 of a diaphragm. Additionally, nickel titanium wire having different thickness may be located at different points on a membrane layer 401. For example, a first nickel titanium wire 402 may comprise a first thickness. A second nickel titanium wire 408 may comprise a second thickness. Lastly, a third nickel titanium wire 414 may comprise a third thickness. The thickness of the nickel titanium wire, for example, can program the frequency range adjusted by certain heating current that is electrically coupled through a particular nickel titanium wire. Typically, the thicker the nickel titanium wire, the more current that it can handle and therefore the higher that the temperature range for it to move and change shape. In view of the discussion above, many arrangements of nickel titanium wire for use with the membrane 400 should be obvious to those of ordinary skill in the art, and, accordingly, are considered to be covered within the scope of the present invention.

Figure 6:
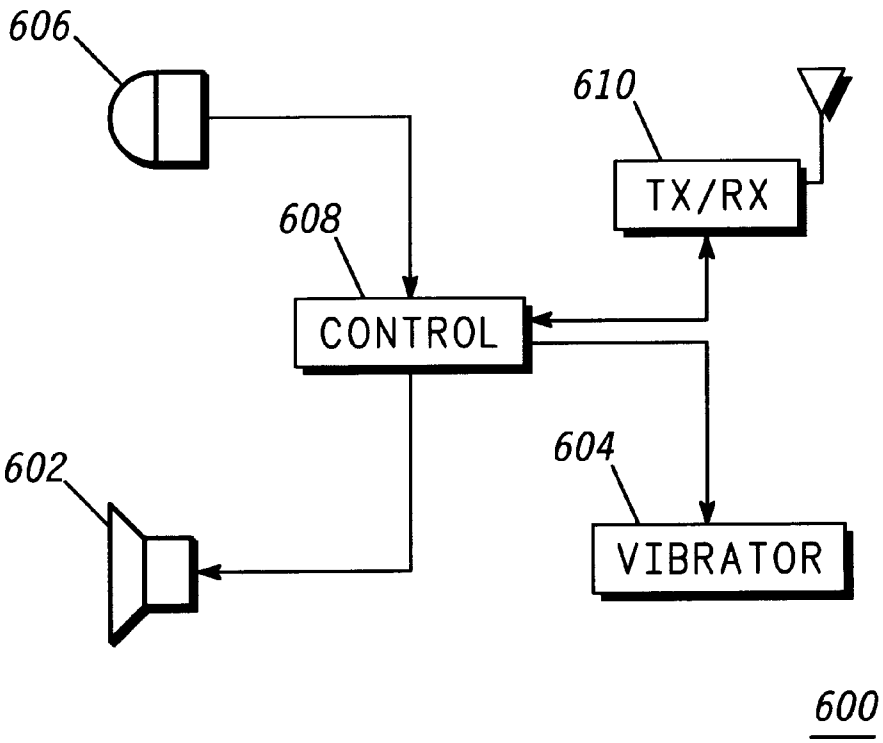
FIG. 6 is a block diagram illustrating a communication device including exemplary electrical transducer devices utilizing nickel titanium memory metal in accordance with a preferred embodiment of the present invention.

As illustrated in FIG. 6, a wireless communication device 600, such as a cellular telephone, a pager, a cordless telephone, a two-way portable radio, or other such wireless communicator, typically includes a number of vibrating transducers such as a microphone 606, a vibrator 604, and a speaker 602. A control module 608, that typically includes a controller circuit, memory circuit, and control and audio multiplexing circuits is electrically coupled to the microphone 606, to the vibrator 604, and to the speaker 602.

Further, a transceiver module 610 is electrically coupled to the controller 608 for conducting wireless communication between the wireless communication device 600 and other users of a communication system (not shown). In one exemplary wireless communication device 600, a user of the device 600 is capable of communicating the signals between the device 600 and another user in a communication system. Voice audio, for example from the user of the device 600 is detected by the microphone 606 and coupled to the wireless transceiver 610 to wirelessly transmit the audio signal from the communication device 600 through a wireless communication channel to another user in the wireless communication system.

For example, the wireless communication device 600 may be a cellular telephone 600 and the other user of the wireless communication system may be a user of a second cellular telephone. Audio transmitted from the second user in the communication system (not shown) is received through the wireless transceiver 610 coupled to the speaker 602 which then generates the audio signal that is audible by the user of the wireless communication device 600. In this example, the speaker 602 may be part of an ear piece for a cellular telephone 600 and the microphone 606 may be part of the mouth piece of the cellular telephone 600.

Alternatively, the speaker 602 may be part of a speaker phone feature of a cellular telephone 600. Additionally, when a communication initiation signal is received by the wireless communication device 600, such as to indicate that another user is attempting to initiate communication with the wireless communication device 600, the controller 608 may send a signal to the vibrator 604 to provide a silent tactile indication to the user of the wireless communication device 600 to indicate the commencement of a communication sequence. In this way, as can be seen from the example above, there are many vibrating transducer devices within the wireless communication device 600. All of these transducing devices can benefit from the significant advantages provided by the novel use of the nickel titanium in the vibrating membrane of the vibrating transducer, in accordance with the preferred embodiments of the present invention.

Therefore, according to the preferred embodiments, a diaphragm comprises a vibratory membrane (200, or 300, or 400), and at least one nickel titanium memory metal member (202, or 302, 304, 306, and 308, or 402, 408, and 414) mechanically coupled to the vibratory membrane (200, or 300, or 400), wherein the at least one nickel titanium memory metal member (202, or 302, 304, 306, and 308, or 402, 408, and 414) is mechanically responsive to a heating signal for changing the frequency response of the vibratory membrane (200, or 300, or 400). Further, the vibratory membrane (200, or 300, or 400) may be part of a vibratory transducer that comprises at least one of a speaker 602, a microphone 606, and a vibrator 604. A wireless communication device 600, such as a cellular telephone, a two-way communicator, and a paging device, can benefit from the present invention by utilizing embodiments of the vibratory such as for a speaker 602, a microphone 606, and a vibrator 604, that are included in the wireless communication device 600.

Although specific embodiments of the invention have been disclosed, it will be understood by those having ordinary skill in the art that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A diaphragm for use in a vibratory transducer device comprising:

a vibratory membrane;

at least one nickel titanium memory metal member mechanically coupled to the vibratory membrane, wherein the at least one nickel titanium memory metal member is mechanically responsive to at least one heating signal for changing the frequency response of the vibratory membrane.

2. The diaphragm of claim 1, wherein the at least one nickel titanium memory metal member is integral to the vibratory membrane.

3. The diaphragm of claim 1, wherein the at least one nickel titanium memory metal member comprises at least one section of nickel titanium sheet mechanically coupled to the vibratory membrane, the at least one section being mechanically responsive to the at least one heating signal, for changing the frequency response of the vibratory membrane.

4. The diaphragm of claim 3, wherein the vibratory membrane comprises at least one section of membrane material, and wherein the at least one section of nickel titanium sheet is mechanically coupled to the at least one section of membrane material about at least one edge extending in a radially outward direction from the center of the vibratory membrane.

5. The diaphragm of claim 4, wherein the at least one section of nickel titanium sheet is bonded to the at least one section of membrane material about the at least one edge.

6. The diaphragm of claim 3, wherein the vibratory membrane comprises a membrane layer, and wherein the at least one section of nickel titanium sheet is mechanically coupled to the surface of membrane layer.

7. The diaphragm of claim 6, wherein the at least one section of nickel titanium sheet is bonded to the surface of the membrane layer.

8. The diaphragm of claim 7, wherein the at least one section of nickel titanium sheet is adhesively bonded to the surface of the membrane layer.

9. The diaphragm of claim 1, wherein the at least one nickel titanium memory metal member comprises at least one nickel titanium wire mechanically coupled to the vibratory membrane, the at least one wire being mechanically responsive to at least one heating signal, for changing the frequency response of the vibratory membrane.

10. The diaphragm of claim 9, wherein the at least one nickel titanium wire is bonded to the surface of the vibratory membrane.

11. The diaphragm of claim 10, wherein the at least one nickel titanium wire is adhesively bonded to the surface of the vibratory membrane.

12. The diaphragm of claim 9, wherein the vibratory membrane comprises a membrane layer, and wherein the at least one nickel titanium wire is integrally coupled to the membrane layer.

13. The diaphragm of claim 9, wherein the vibratory membrane comprises a membrane layer, and wherein the at least one nickel titanium wire is stitched to the membrane layer.

14. The diaphragm of claim 1, wherein the transducer device is a speaker, a microphone, or a vibrator.

15. A vibrating transducer comprising:

a diaphragm, including a vibrating membrane that is a sheet of nickel titanium memory metal; and a heating signal source coupled to the diaphragm, the heating signal source generating a heating signal for changing the frequency response of the vibratory membrane.

16. The vibratory transducer of claim 15, wherein the at least one nickel titanium memory metal member comprises at least one nickel titanium wire mechanically coupled to the vibratory membrane, the at least one wire being mechanically responsive to the at least one heating signal, for changing the frequency response of the vibratory membrane.

17. The vibratory transducer of claim 16, wherein the at least one nickel titanium wire is bonded to the surface of the vibratory membrane.

18. The vibratory transducer of claim 17, wherein the at least one nickel titanium wire is adhesively bonded to the surface of the vibratory membrane.

19. The vibratory transducer of claim 16, wherein the vibratory membrane comprises a membrane layer, and wherein the at least one nickel titanium wire is integrally coupled to the membrane layer.

20. The vibratory transducer of claim 16, wherein the vibratory membrane comprises a membrane layer, and wherein the at least one nickel titanium wire is stitched to the membrane layer.

21. A vibratory transducer comprising:

a diaphragm including a vibratory membrane; and at least one nickel titanium memory metal member mechanically coupled to the vibratory membrane, wherein the at least one nickel titanium memory metal member is mechanically responsive to at least one heating signal for changing the frequency response of the vibratory membrane.

22. The vibratory transducer of claim 21, wherein the vibratory transducer comprise at least one of a speaker, a microphone, and a vibrator.

23. The vibratory transducer of claim 21, wherein the at least one nickel titanium memory metal member is integral to the vibratory membrane.

24. The vibratory transducer of claim 21, wherein the at least one nickel titanium memory metal member comprises at least one section of nickel titanium sheet mechanically coupled to the vibratory membrane, the at least one section being mechanically responsive to the at least one heating signal, for changing the frequency response of the vibratory membrane.

25. The vibratory transducer of claim 24, wherein the vibratory membrane comprises at least one section of membrane material, and wherein the at least one section of nickel titanium sheet is mechanically coupled to the at least one section of membrane material about at least one edge extending in a radially outward direction from the center of the vibratory membrane.

26. The vibratory transducer of claim 25, wherein the at least one section of nickel titanium sheet is bonded to the at least one section of membrane material about the at least one edge.

27. The vibratory transducer of claim 24, wherein the vibratory membrane comprises a membrane layer, and wherein the at least one section of nickel titanium sheet is mechanically coupled to the surface of membrane layer.

28. The vibratory transducer of claim 27, wherein the at least one section of nickel titanium sheet is bonded to the surface of the membrane layer.

29. The vibratory transducer of claim 28, wherein the at least one section of nickel titanium sheet is adhesively bonded to the surface of the membrane layer.

30. A wireless communication device comprising:

a wireless transceiver for wirelessly communicating information signals in a wireless communication system;

at least one vibratory transducer;

a controller, electrically coupled to the wireless transceiver and to the at least one vibratory transducer, for communicating information signals with a user of the wireless communication device via the at least one vibratory transducer, and wherein the at least one vibratory transducer includes:

a diaphragm including a vibratory membrane; and at least one nickel titanium memory metal member mechanically coupled to the vibratory membrane, wherein the at least one nickel titanium memory metal member is mechanically responsive to at least one heating signal for changing the frequency response of the vibratory membrane.

31. The wireless communication device of claim 30, wherein the wireless communication device comprises at least one of a cellular telephone, a two-way communicator, and a paging device.

32. The wireless communication device of claim 30, wherein the at least one vibratory transducer comprises at least one of a speaker, a microphone, and a vibrator.

33. The wireless communication device of claim 30, wherein the vibratory membrane is a sheet of nickel titanium memory metal.

34. The wireless communication device of claim 31, wherein the at least one nickel titanium memory metal member comprises at least one section of nickel titanium sheet mechanically coupled to the vibratory membrane, the at least one section being mechanically responsive to the at least one heating signal, for changing the frequency response of the vibratory membrane.

35. The wireless communication device of claim 31, wherein the at least one nickel titanium memory metal member comprises at least one nickel titanium wire mechanically coupled to the vibratory membrane, the at least one wire being mechanically responsive to the at least one heating signal, for changing the frequency response of the vibratory membrane.

* * * * *

UNITED STATES PATENT AND TRADEMARK OFFICE

CERTIFICATE OF CORRECTION

PATENT NO. : 6,563,934 B1
DATED : May 13, 2003
INVENTOR(S) : Swope et al.

It is certified that error appears in the above-identified patent and that said Letters Patent is hereby corrected as shown below:

Column 1,
Lines 62 and 65, “an diaphragm” should read -- a diaphragm --

Column 4,
Line 7, insert -- to -- between “coupled a”

Column 6,
Line 50, insert -- transducer -- after “vibratory”

Column 8,
Line 24, “comprise” should read -- comprises --

Column 10,
Lines 4 and 10, insert -- 31 -- between “30”

Signed and Sealed this

Twenty-sixth Day of August, 2003

JAMES E. ROGAN
*Director of the United States Patent and Trademark Office*